United States Patent [19]

Conn

[11] 4,269,332

[45] May 26, 1981

[54] CONTAINER WITH TUBE CLOSURE ASSEMBLY

[76] Inventor: John L. Conn, P.O. Box 4501-Station B, Spartanburg, S.C. 29303

[21] Appl. No.: 11,152

[22] Filed: Feb. 9, 1979

[51] Int. Cl.[3] ..... B67D 5/06

[52] U.S. Cl. ..... 222/475; 222/484; 222/528; 222/530; 222/568; 220/94 R; 220/85 SP

[58] Field of Search ..... 222/475, 482, 484, 530, 222/528, 538, 568; 220/94 R, 288, 85 SP

[56] References Cited

U.S. PATENT DOCUMENTS

| | | | |
|---|---|---|---|
| 145,999 | 12/1873 | Hallock | 222/571 X |
| 625,384 | 5/1899 | Dewhurst et al. | 222/538 X |
| 1,544,503 | 6/1925 | Thomson | 222/475 |
| 1,838,468 | 12/1931 | Thomson | 222/475 |
| 3,966,076 | 6/1976 | Kroger et al. | 220/94 A X |

FOREIGN PATENT DOCUMENTS

| | | | |
|---|---|---|---|
| 252652 | 6/1926 | United Kingdom | 222/530 |

*Primary Examiner*—Charles A. Marmor

[57] ABSTRACT

A hollow rectangular shaped container having side walls, and smaller end walls, and having a bottom, and a top wherein said top of container has two threaded openings whereby a flexible tube that is threaded on both ends will serve as a closure to seal container, and also serve as a handle, and also serve as a nozzle, and also as a drinking tube.

1 Claim, 1 Drawing Figure

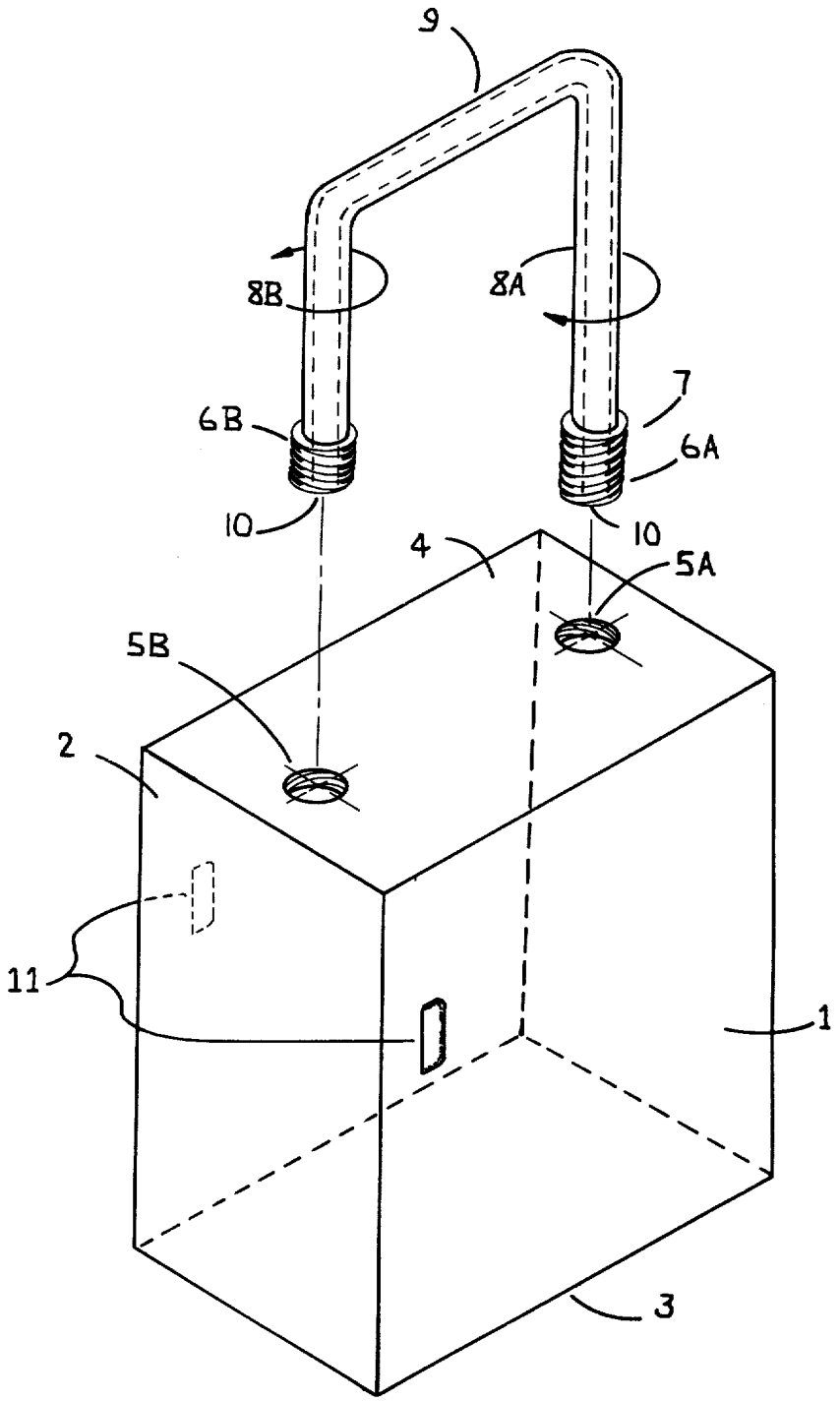
9
8B
8A
7
6B
6A
10
10
4
5A
5B
2
11
1
3

CONTAINER WITH TUBE CLOSURE ASSEMBLY

This invention relates generally to the common liquid container and nozzle.

A principle object of the present invention is to provide a container with tube closure and/or nozzle and/or handle and/or drinking tube whereby the closure tube will also serve as a nozzle.

Another object of the present invention is to provide a container with tube closure and/or nozzle and/or handle and/or drinking tube whereby the closure tube will also serve as a handle.

Another object is to provide a container with tube closure and/or nozzle and/or handle and/or drinking tube whereby the closure tube will also serve as a drinking tube.

Other objects are to provide a container with a closure tube and/or nozzle and/or handle and/or drinking tube that can be made from molded plastic, simple in design, inexpensive to make, and easy to use.

These and other objects will readily be evident upon a study of the following specifications and the accompanying drawing.

Referring now to the Fig. in detail, the present invention represents a hollow rectangular shaped container having two side walls (1), and having two smaller end walls (2), and having a bottom (3), and having a top (4) wherein the top (4) contains two internally threaded openings (5A and 5B) located near the outer central top surface near the smaller ends (2) wherein the right top opening (5A) is internally threaded and of right-handed threads (5A), wherein the left top opening (5B) is internally threaded and of left-handed threads (5B) wherein each opening having the same circumference.

A flexible rubber or plastic hollow tube with opening (10) is constructed with external left-handed threads on the left end (6B), and the other right end of said tube (6A) is provided with external right-handed threads (6A) that are extended to a greater length-wise threaded area (7) than the other end (6B).

To seal the container will be by screw connecting the flexible tube at the end area (6A) to the container's opening (5A) so to rest the tube at the extended threaded area (7) and then proceed to partly back-screw the tube while the other tube end (6B) is being screw connected to the container's opening (5B) wherein said tube will close said container and form a handle (9).

Be it also stated that the container may be sealed by shaping the tube in an inverted "U" shaped position wherby said tube's both ends (6A and 6B) can be screwed into the container's openings (5A and 5B) at the same time by placing the right hand on the tube's right end (6A) and the left hand on the left end (6B) wherein the right end (6A) will connect by turning said end clockwise (8A) and wherein the left hand will turn the left end of the tube (6B) by turning said end counterclockwise (8B) whereby the entire flexible tube will thus revolve.

Be it stated that the flexible tube is of a greater length than the distance between the two container's openings (5A and 5B) so to allow said to revolve (8A and 8B) when sealing container and also to form a nozzle, handle (9), or drinking tube. The central non-threaded area of the tube (9) is smaller in circumference than the two threaded ends (6A and 6B) so to screw tube into the container to construct a drinking tube.

The nozzle is formed by dis-connecting the left end (6B) of the tube (FIG. B) from container.

The container can be held by the hand at the indented exterior finger gripping areas (11) when the nozzle is to be used.

Be it noted that the flexible closure tube will serve the following uses;

1. As a closure means.
2. As a handle assembly.
3. As a nozzle assembly.
4. As a drinking tube.

While various changes may be made in the general design and construction, it is understood that such changes will not change the spirit and scope of the present invention as is defined by the claims.

What is claimed:

1. A hollow container that is rectangular in shape and having two side walls, two smaller end walls, a bottom, a top, wherein said top surface of the container has two internally threaded openings located near the smaller end walls, the one left opening having left-handed internal threads and the other opposite right opening having right-handed internal threads and two opposite indented finger gripping areas located on the larger exterior side walls near the smaller left end wall, in combination with a flexible hollow closure tube wherein said tube is of a greater length than the distance between said two top surface openings, the circumference of the tube's externally threaded ends are equal to that of the two top surface openings, the tube's left end is externally threaded with left-handed threads and the other right tube end having externally threaded right-handed threads wherein the tube's left externally threaded end and the container's left internally threaded opening are of like threads and wherein the tube's right externally threaded end and the container's right internally threaded opening are of like threads, the tube's right externally threaded end area has a greater length-wise threaded area than that of the other left end, the central non-threaded area of the tube is of a smaller circumference than the two threaded end areas and wherein said tube and threaded end portions are of one integral piece.

* * * * *